US005672043A

United States Patent [19]

Hagara

[11] Patent Number: 5,672,043

[45] Date of Patent: Sep. 30, 1997

[54] LIFTING AND SWIVELLING DEVICE, IN PARTICULAR FOR MOTOR VEHICLES

[76] Inventor: Ludwig Hagara, Hebbelgasse 4/4, A-1100 Vienna, Austria

[21] Appl. No.: 586,776

[22] PCT Filed: Jul. 29, 1994

[86] PCT No.: PCT/AT94/00103

§ 371 Date: Jan. 30, 1996

§ 102(e) Date: Jan. 30, 1996

[87] PCT Pub. No.: WO95/03992

PCT Pub. Date: Feb. 9, 1995

[30] Foreign Application Priority Data

Jul. 30, 1993 [AT] Austria ..... 1521/93

[51] Int. Cl.[6] ..... B66F 7/22

[52] U.S. Cl. ..... 414/678; 254/3 B; 414/778

[58] Field of Search ..... 254/3 B, 3 C, 254/3 R, 4 B, 4 C, 4 R, 127; 414/678, 778, 780, 781, 782

[56] References Cited

U.S. PATENT DOCUMENTS

| | | | |
|---|---|---|---|
| 2,622,746 | 12/1952 | Campling . | |
| 4,971,511 | 11/1990 | Stevens et al. | 414/678 |
| 5,174,711 | 12/1992 | Binder et al. | 414/678 |

FOREIGN PATENT DOCUMENTS

| | | | |
|---|---|---|---|
| 250191 | 2/1966 | Austria | 414/678 |
| 0285292 | 10/1988 | European Pat. Off. . | |
| 0410013 | 1/1991 | European Pat. Off. . | |
| 2533398 | 2/1976 | Germany | 414/678 |
| 3442837 | 6/1985 | Germany . | |
| 3503363 | 8/1985 | Germany . | |

*Primary Examiner*—Karen B. Merritt
*Assistant Examiner*—Janice L. Krizek
*Attorney, Agent, or Firm*—Friedrich Kueffner

[57] ABSTRACT

A lifting and swivelling apparatus for objects, in particular for motor vehicles and the like, includes substantially horizontally extending tie rods (28) and a clamping frame (4, 5), which can pivot about a substantially horizontal axis of the tie rods, and a lifting device (24) which can pivot about a substantially horizontal axis of the tie rods (28) and is connected in an articulated manner to the clamping frame (4, 5) via a holding member (23) which is displaceable along said lifting device, the holding member (23) being designed to be displaceable along the lifting device (24) by an actuating device and to be locked in position at any point desired, wherein the clamping frame (4, 5), on its side facing away from the lifting device, is provided with a supporting frame (15) which is curved substantially through 90° and subsequently continues rectilinearly, and in that fastening member (10, 14) are provided on the clamping frame (4, 5) to lock the object to be tilted in position.

5 Claims, 7 Drawing Sheets

FIG.12
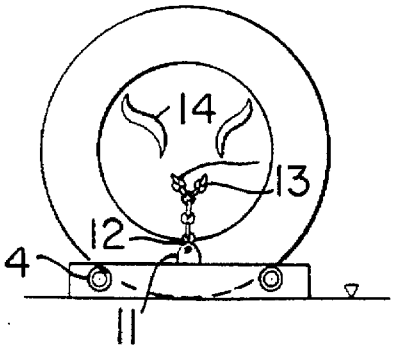
FIG.4A
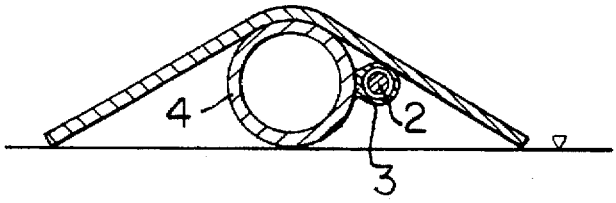
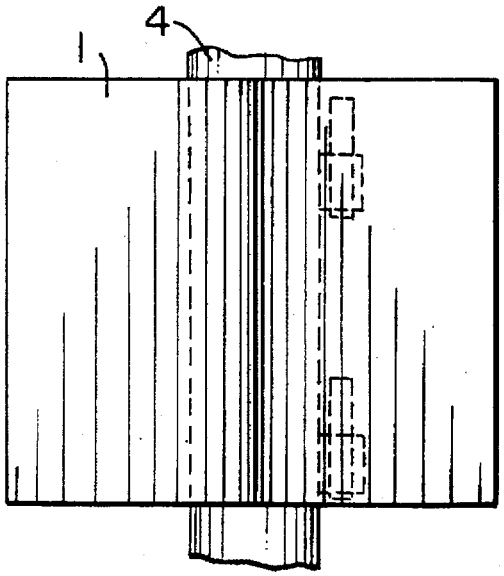
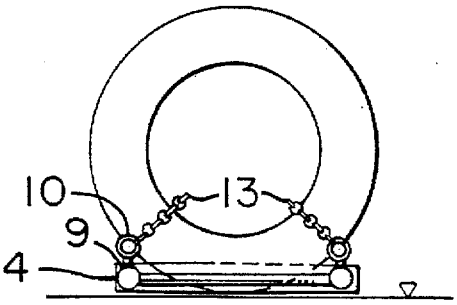
FIG.13
FIG.4B
FIG.9A
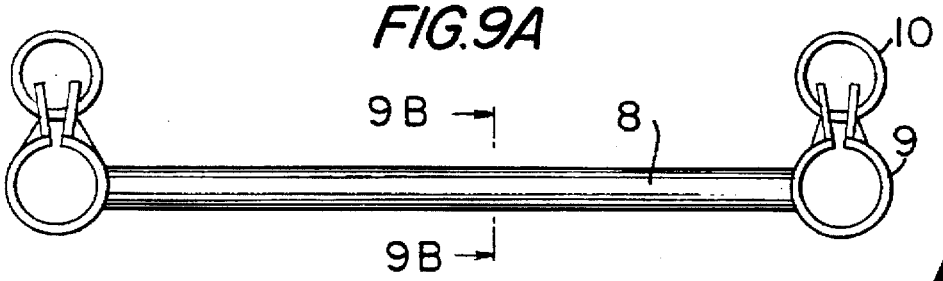
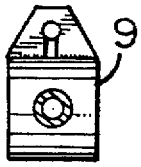
FIG.9B
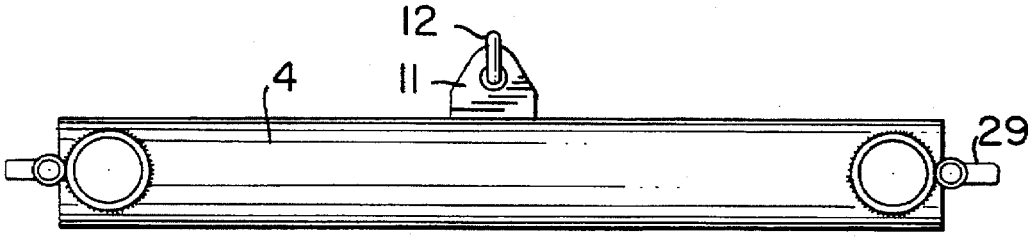
FIG.10

LIFTING AND SWIVELLING DEVICE, IN PARTICULAR FOR MOTOR VEHICLES

BACKGROUND OF THE INVENTION

1. Field of the Invention

The invention relates to a lifting and swivelling apparatus for objects, in particular motor vehicles and the like, comprising substantially horizontally extending tie rods, a frame which can swivel about a substantially horizontal axis of the tie rods, and a lifting device which can swivel about a substantially horizontal axis of the tie rods and is connected to the frame in an articulated manner by means of a holding means which is displaceable along the lifting device, the holding means being designed to be displaceable along the lifting device and being lockable in position at any point desired, via an actuating device.

2. Description of the Prior Art

A lifting apparatus of this kind is known from EP-A 0 285 292. In that instance, it is used exclusively to tilt a vehicle, to which is attached a so-called "automobile cradle", in order to prevent manual tilting. Subsequently, the lifting apparatus is removed, and the automobile rests in the cradle.

The drawbacks in this apparatus are the absence of connecting means between the cradle and the lifting apparatus during the lifting operation, and the danger that the automobile will tilt back once the lifting apparatus has been removed.

A further tilting apparatus according to EP-A 0 410 013 overcomes these drawbacks but, in order to use the apparatus, the vehicle must be jacked up so that all wheels can be removed and corresponding parts of the apparatus can be mounted on the wheel mounts. This work outlay is justified for a total overhaul of the bottom plate, but not for an inspection.

SUMMARY OF THE INVENTION

The object of the invention is to provide an apparatus of the kind mentioned at the outset, which does not have the disadvantages of known apparatus, while being easy to operate and reliable during all stages of use.

According to the invention, this object is achieved in that the frame is a clamping frame which, on its side facing away from the lifting device, has a supporting frame which is curved substantially through 90° and subsequently continues to extend rectilinearly, and in that fastening means are provided on the clamping frame for the purpose of locking the object to be tilted into position. It is for this reason that the frame is referred to as a clamping frame in the description and in the claims.

Accordingly, the invention relates in particular to a tilting apparatus for motor vehicles, trailers, freight cars, machines, and structural members, which is supported at four points and includes the clamping frame which can be swivelled into dead center by means of a lifting device which is connected to the frame in an articulated manner, in order to provide access, in a simple manner, to the underside of the object to be tilted for the purpose of carrying out maintenance, repair or assembly work. The apparatus preferably includes means via which the objects on which work is to be carried out, in so far as they are motor vehicles, can be driven into the tilting apparatus and locked in position on the clamping frame of the tilting apparatus by means of a clamping device, without necessitating the removal of the wheels, and can be brought, by a person with little expenditure of force, into a position as required to carry out work by means of a winch or a similar lifting device, wherein a means to prevent overtipping prevents any overturning. The return into the starting position is carried out by a return movement of the lifting device.

The safety device according to the invention takes into consideration that the different dimensions of the objects to be tilted, in particular motor vehicles, produce different tilting angles according to the different positions of their centers of gravity, which necessitates a variable tipping angle adjusting means to permit a reliable prevention of overtipping.

The tilting apparatus according to the invention is characterized, in particular, in that an adjustable means to prevent overtipping reliably prevents any danger of tipping over, and that it can be adapted to all different tilting angles.

According to the invention, on the one hand, a secure connection is provided between the actual lifting apparatus and the supporting frame, which serves as a cradle, and a rolling-back is reliably prevented while, on the other hand, any preparation of the object, in particular the vehicle, is rendered unnecessary.

The clamping frame is preferably connected to the lifting device by means of tie rods in a manner such that the tie rods are connected to the clamping frame in an articulated manner in the center of the adjusted wheel track, so that the lifting device will always be in vertical position at any degree of the tilting angle.

Assembly pits and hoisting platforms, which necessitated architecturally designed structural arrangements for their installation, were previously used for work on the underside of the vehicle. The tilting apparatus according to the invention is mobile and can be erected on a level surface and operated in any location required.

Similar tilting apparatus has the drawback that the objects to be tilted must be raised in order to be brought into the tilting apparatus, which is labor-intensive and time-consuming, or that, in the case of a vehicle, the wheels must be removed and the vehicle must be attached to special holding means before the object can be brought into the corresponding working position. According to the utilization of the tilting apparatus according to the invention, stationary machines can be swivelled into the clamping frame.

BRIEF DESCRIPTION OF THE DRAWINGS

The invention will be explained more fully in the following with reference to the drawings:

FIG. 4 shows a drive-in and drive-out ramp in section and in a top view;

FIG. 9 shows a clamping rail for the object to be tilted;

FIG. 10 shows a view of the clamping frame as seen from the end side;

FIGS. 12 and 13 show variants of a clamping device;

DESCRIPTION OF THE PREFERRED EMBODIMENTS

Figure 1:
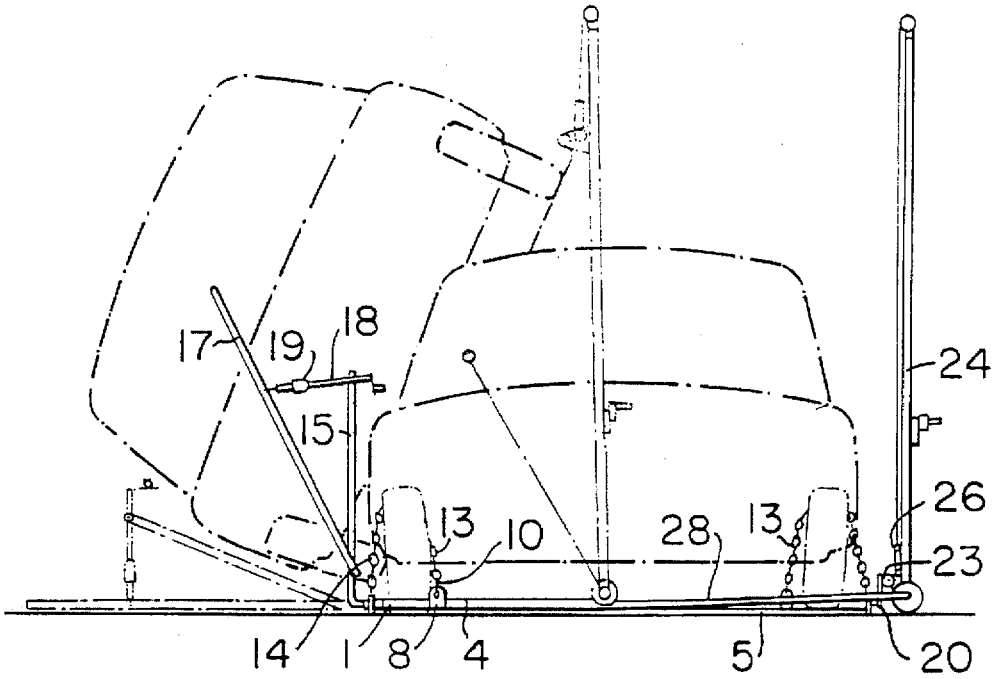
FIG. 1 shows an apparatus according to the invention, together with a vehicle in the drive-in position and in the tilted position.
Figure 8A:
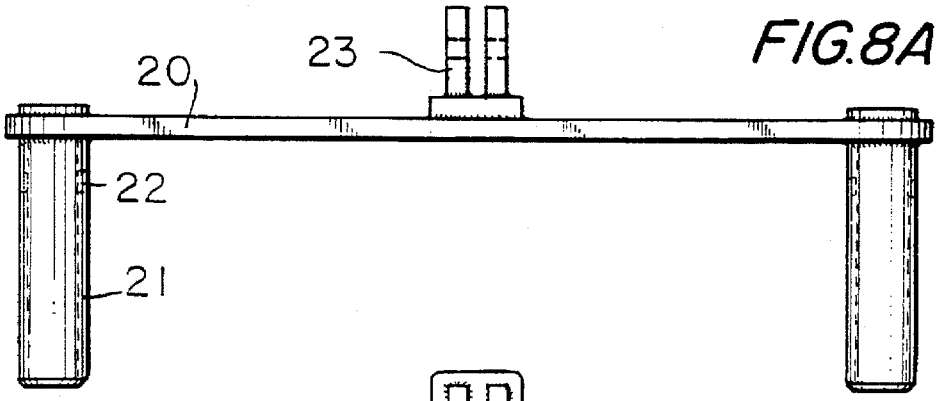
FIG. 8 shows the end of the clamping frame facing the lifting apparatus.
Figure 8B:
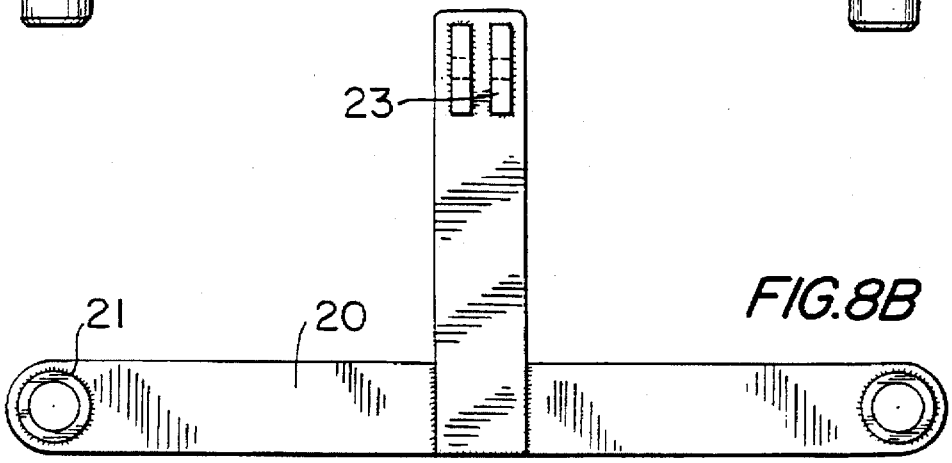

As will be seen from FIG. 1, the object to be tilted is attached to a clamping frame 4 by clamping chains or clamping belts 14. At one side, the clamping frame 4 is provided with a supporting frame which may or may not be constructed integral therewith. At the other end, the clamping frame is fitted in an articulated manner to a lifting apparatus 24 by means of brackets 23.

At least one tie rod 28 extends between the clamping frame 4 and the lower part of the lifting apparatus 24 so that the clamping frame, lifting apparatus and tie rods always form a triangle and are accordingly statically defined.

Two extension arms 17 can be spread out at a desired angle at the supporting frame 15 by means of adjusting spindles 18. They prevent the object from tipping over, while the adjusted angle depends on the geometry and on the position of the center of gravity of the object.

Figure 2:
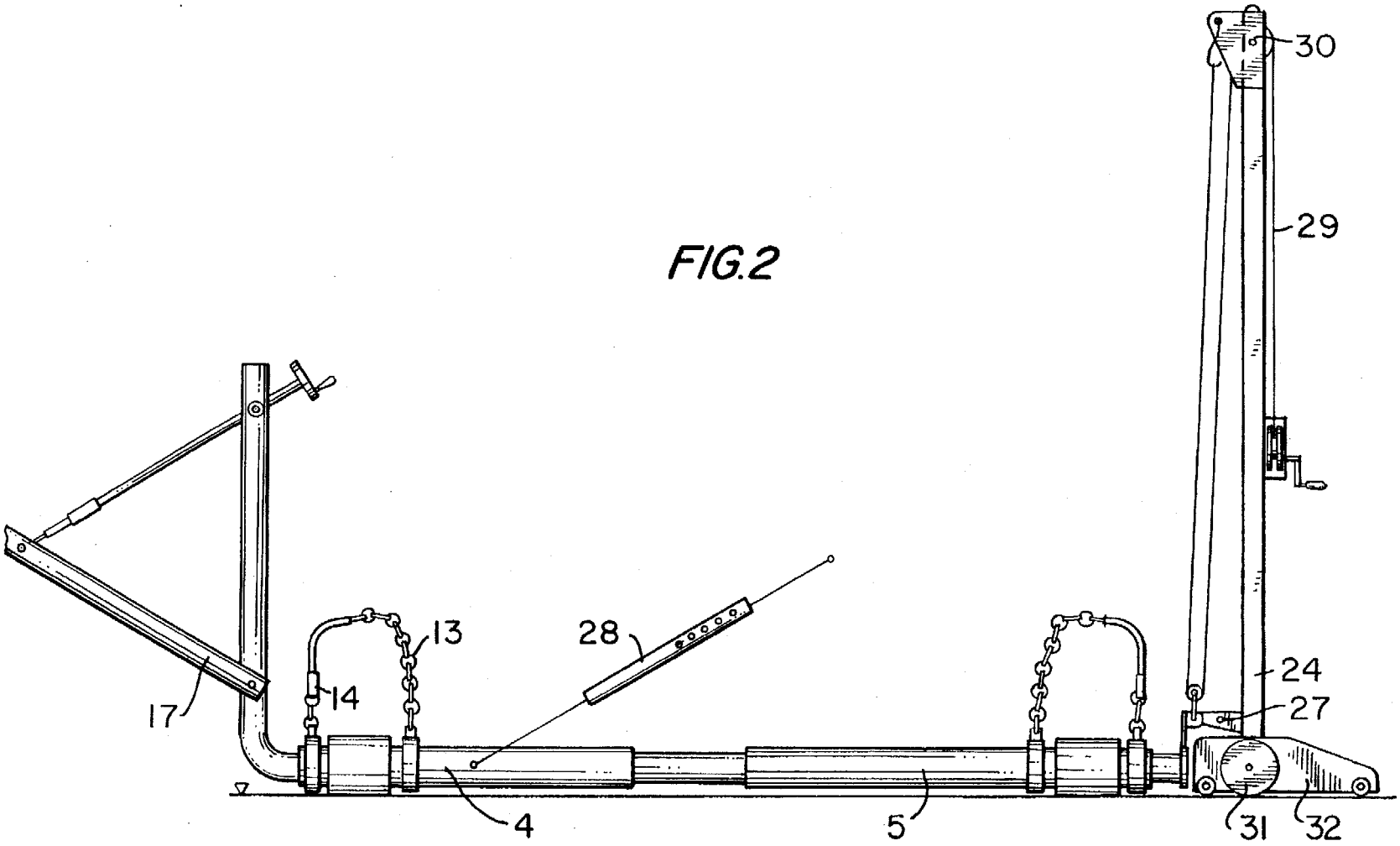
FIG. 2 shows a schematic view of an apparatus, according to the invention, with swivelled out tie rod.

FIG. 2 shows an apparatus according to the invention in analogy to FIG. 1 without an object to be tilted and not yet fully assembled. In this regard, one end of the tie rod 28 is not yet connected to the axle of the wheels 31 of the lifting apparatus 24. This lifting apparatus is shown in more detail than in FIG. 1: a slide 27 slides in a guiding means in the lifting apparatus and is moved by means of a winch and a cable 29. At the top end 30 of the lifting apparatus, the cable is turned around and also runs from the slide back up to the end 30 such that a transmission ratio is achieved in the manner of a pulley block.

At its lower end, the lifting apparatus is provided, during assembly, with a shoe 32 which is removed once the lifting apparatus 24 has been connected to at least one tie rod 28, so that the lifting apparatus can stand freely during assembly, and comprises wheels 31, the tie rods 28 being attached to the axle of these wheels 31 so that, in the course of the actuation thereof, the tie rods 28 can follow the object to be tilted as will be seen from FIG. 1. Further, the wheels 31 make it possible for an individual person to move the entire fully assembled apparatus, in the manner of a sliding cabinet, simply by grasping and raising the extension arms 17.

The use of the apparatus will be described in the following with reference to the tilting of a vehicle without being limited thereto.

Figure 3:
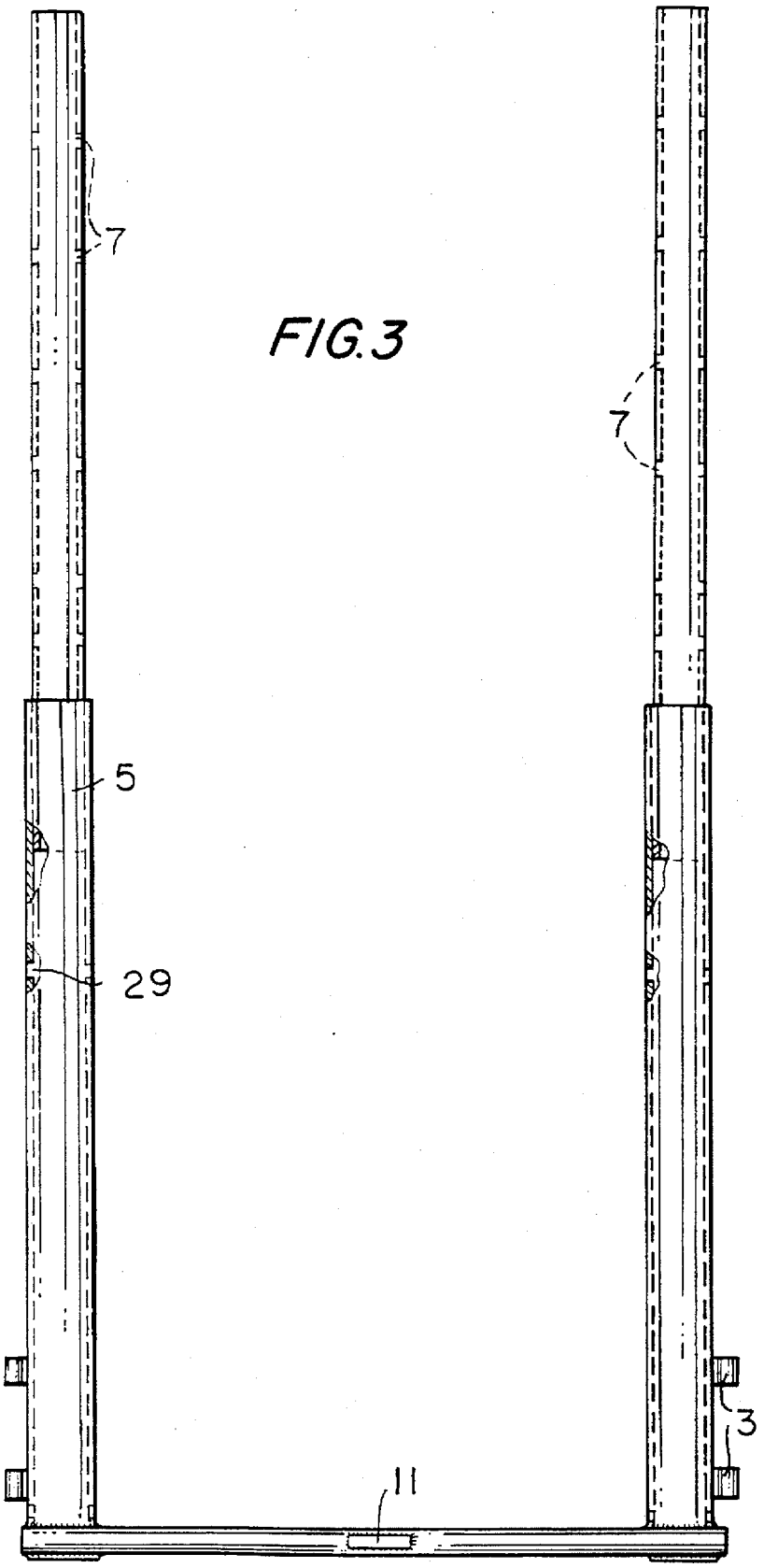
FIG. 3 shows a clamping frame in a top view.
Figure 14:
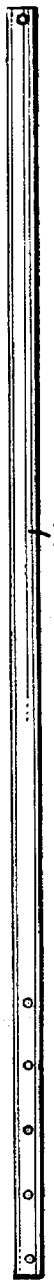
FIG. 14 is a view of the tie rod of the invention.
Figure 7A:
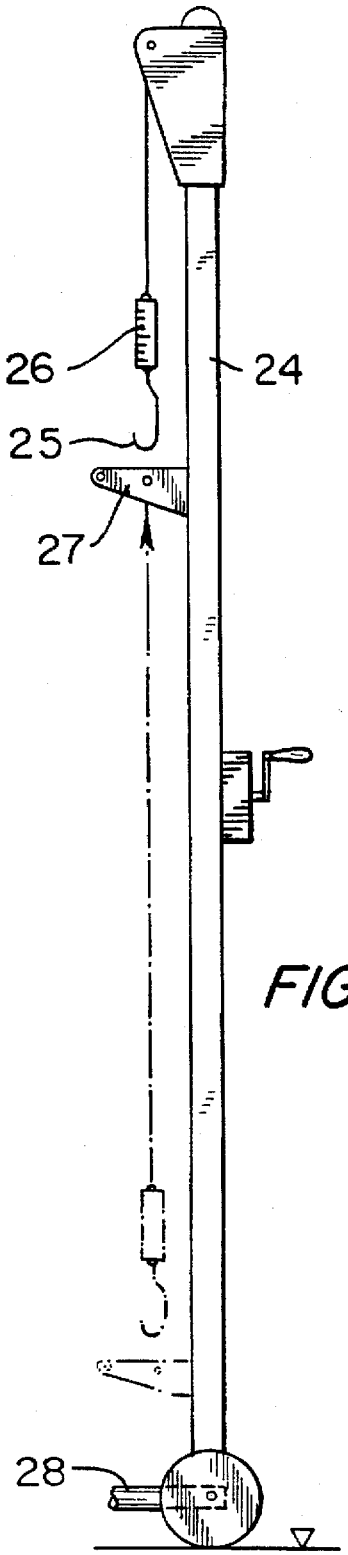
FIG. 7 shows a lifting apparatus.
Figure 7B:
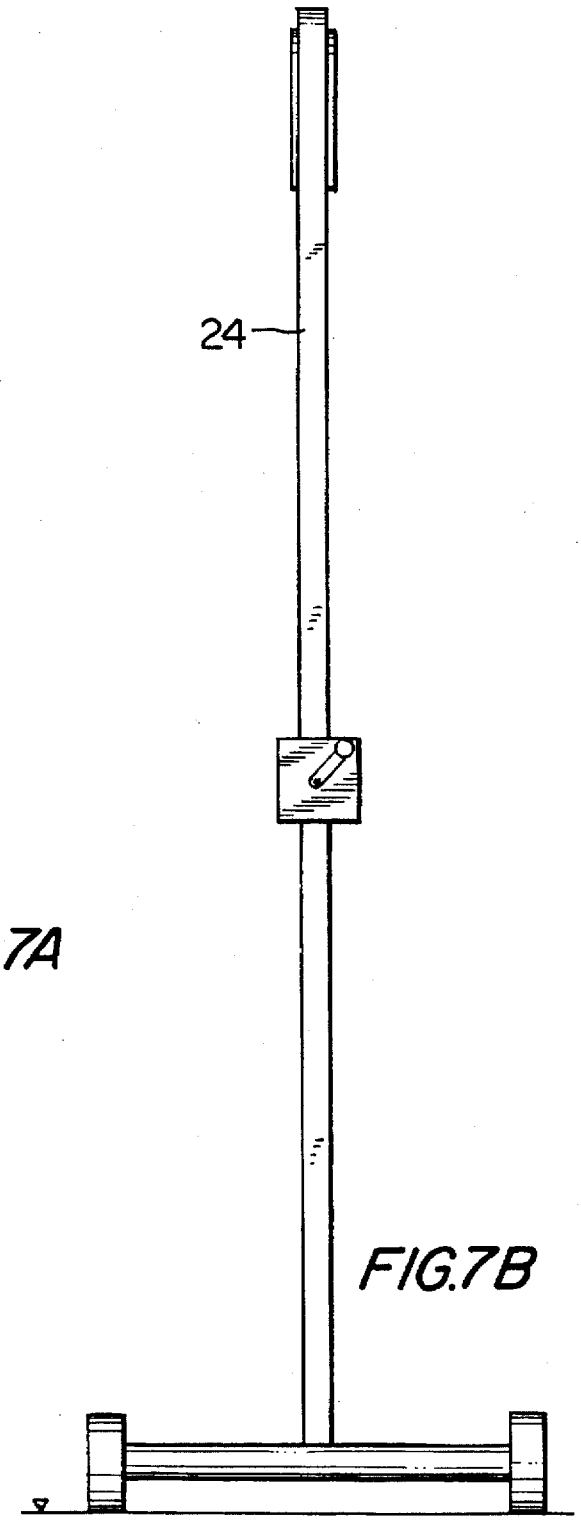
Figure 6:
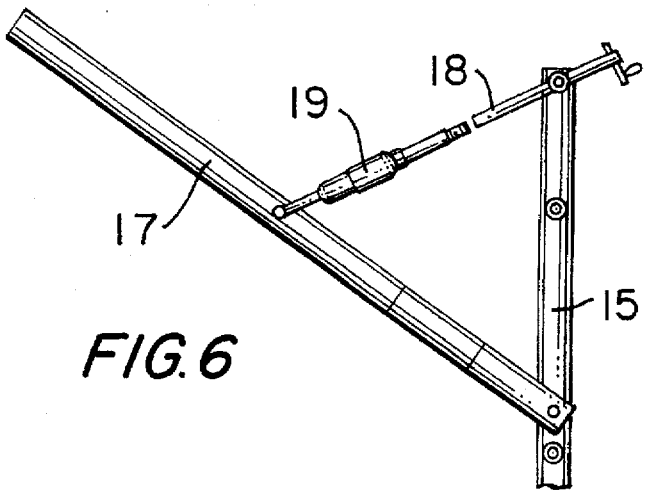
FIG. 6 shows an extension arm which is mounted at the supporting frame.

Using their own wheels, vehicles roll from the right-hand side or left-hand side via a drive-in and drive-out ramp 1 suspended in bushes 3 by pins 2 into a clamping frame 4, 5 which has two parts and which can be adjusted to the width of the workpieces to be manipulated, preferably to the commonly used wheel track of vehicles. The adjustment of the wheel tracks can be set by means of secured bolts via two bore holes 6 which are closely spaced, e.g., at a distance of 4 cm as in FIG. 2 or with a spacing of 8 cm between the bore holes 7 as in FIG. 3. Thus, the wheel tracks are to be located at a spacing corresponding to the spacing of the bore holes 6, in the present example, at a spacing of 4 cm.

The clamping rails are locked at the clamping frame 4, 5 in each instance by one clamping rail 8 via the retaining ring 10 due to the tensile force generated when the wheels are clamped down, this clamping rail 8 sliding on the two clamping frame parts 4, 5 and being connected with clamping bands 9 and contacting the inner side of the wheels. Brackets 11, in which is suspended a ring 12, are arranged at the end faces of the clamping frames 4, 5, the clamping chains 13, 14 being guided by means of the ring 12 at the retaining ring 10, e.g., via the wheels of the vehicles or holding means of the workpieces, and clamped by means of a clamping device 14.

Figure 5B:
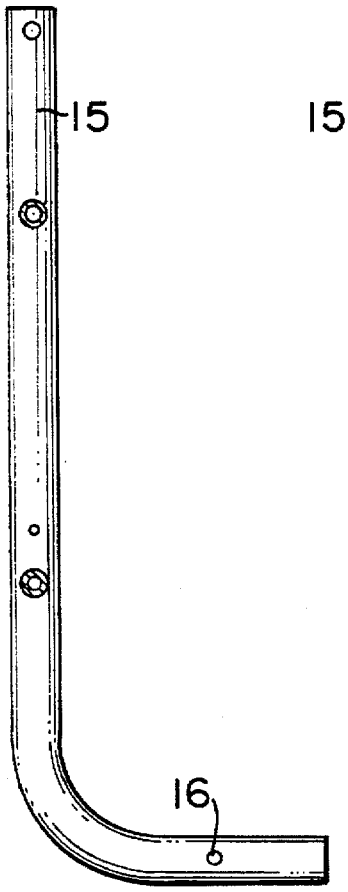
FIG. 5 shows a supporting frame in a side view and in a top view.
Figure 5A:
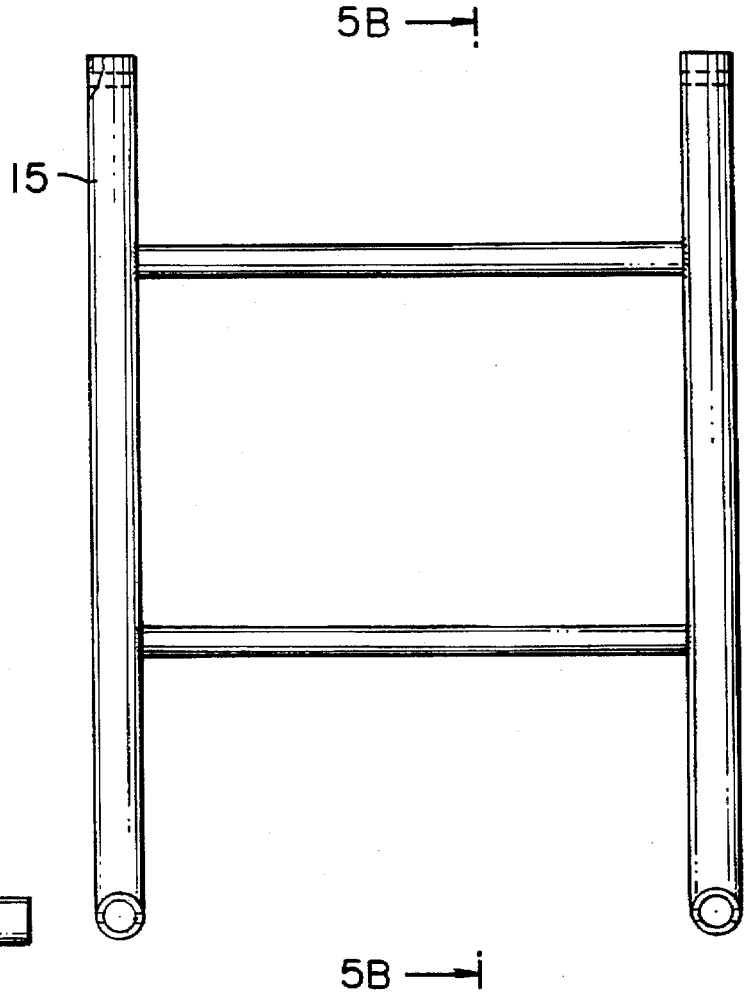
Figure 11:
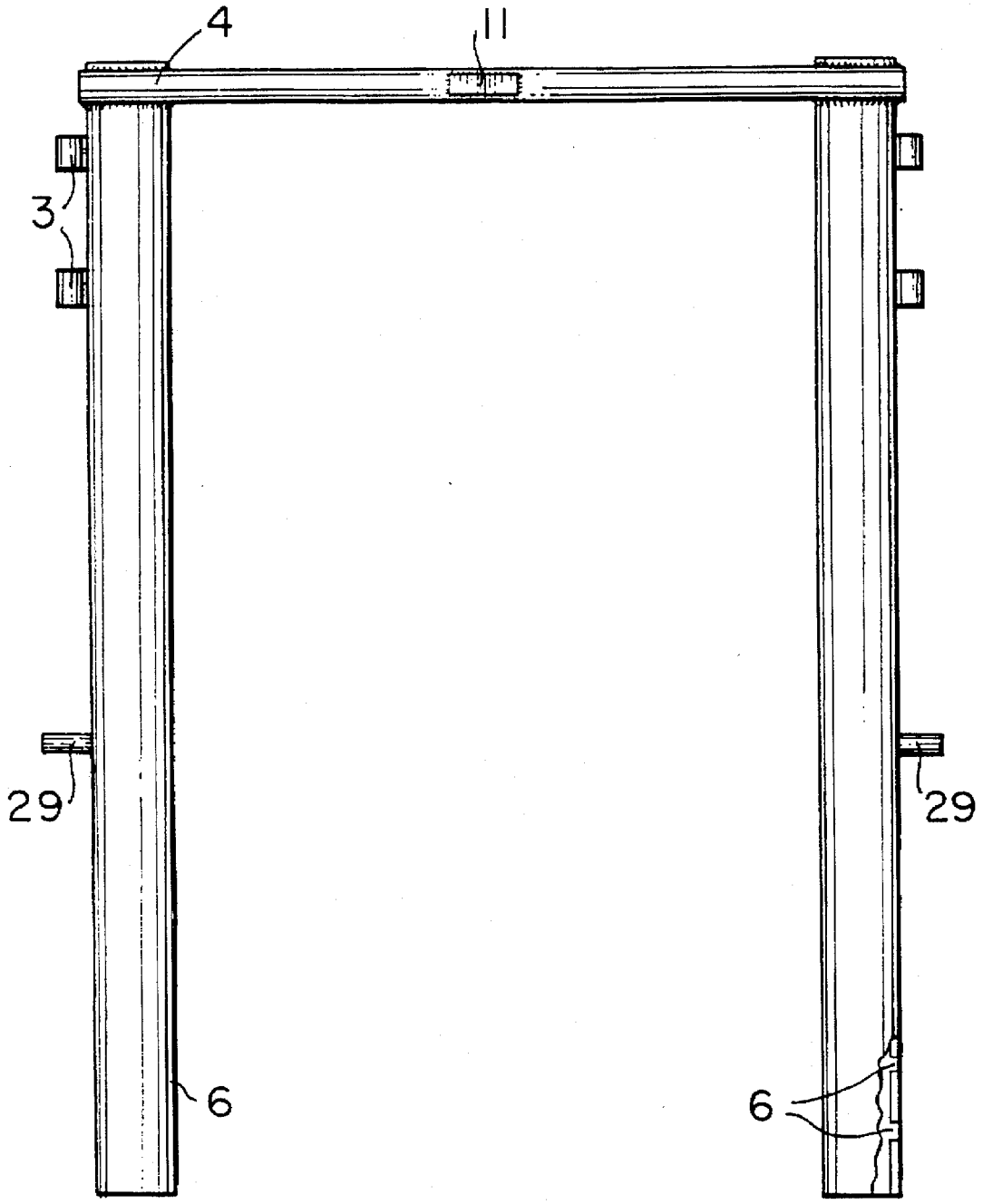
FIG. 11 shows a view of an end of a variant of the clamping frame.

A trussed or reinforced supporting frame 15 (FIG. 5) is attached to the clamping frame 4 at the tilting side, for example, by secured bolts 16. This supporting frame 15 can also be fastened in the same manner at the lifting side of the clamping frame 5 so that the tilting apparatus can be used equally well from both sides.

Two extension or cantilever arms 17 are arranged in an articulated connection on the upper part of the supporting frame 15 means 17, 18, 19 for preventing tipping over, these extension arms 17 being adjustable to the tilting angle which depends on the center of gravity of the workpiece or vehicle. Irregularities or unevenness in the surface upon which the tilting apparatus is erected can be compensated for by two extension arms.

According to the invention, this protection against tipping over is formed of a device which is adjustable to the required height of support and which, for example, has two spindles with a crank 18 to which is attached, for example, a shock absorber on which a marking, for example, a color marking 19, indicates the state of equilibrium:

"green"0 indicates that the tilting side is not loaded and the lifting side is loaded;

"yellow" indicates that the tilting side and lifting side are not loaded and the workpiece or vehicle side is located in the ideal dead center position;

"red" indicates that the tilting side is overloaded and the lifting side is not loaded. In this case, the means for protecting against tipping over prevent the risk of the workpiece or vehicle tipping over.

In conjunction with a load-indicating device 26, e.g., a spring scale, at the lifting device 24, the load still acting upon the lifting device 24 can be displayed during the lifting process in every tilting angle position so that the supporting height the tilting side can be adjusted in a precautionary manner in due time, e.g., the spindle 18 can be adjusted by the crank, and the risk of tipping over can accordingly be eliminated in a reliable manner.

A bracket 23 or other connecting means for receiving a load arm of the lifting device 24 is arranged, as an articulated connection which can be disconnected during assembly and dismantling, on the coupling 20 which is to be attached, depending on spatial and working requirements, to the clamping frame on the lifting side 4, 5, for example, by means of plug-in members 21 and secured bolts 22.

The lifting device 24 is supported on the ground by rollers or wheels and is connected by secured bolts with the clamping frame part 4 or with clamping frame part 5, depending on the working side, by tie rods 28 which are arranged in an articulated manner, wherein the tie rods 28 can be adjusted in length to the wheel track width of the vehicles or other workpieces to be manipulated.

In order to adjust to the wheel track, the tie rods 28 are provided with the same number of bore holes spaced in the same manner as those at the clamping frame 4, 5 and are attached by means of secured bolts which are preferably disposed in the center of the wheel track adjusted at the clamping frame 4, 5 so that the lifting device 24 is disposed during the lifting operation substantially vertically from the smallest up to the greatest angle of inclination of the tilted clamping frame in such a way that the workpiece or vehicle in the clamping frame cannot be contacted by lifting column or lifting device 24.

A preferred design of the invention is characterized in that the two ends of the clamping frame 4, 5 are constructed for fastening the supporting frame 15 and the lifting apparatus 24 and in that a fastening of the supporting frame as well as the lifting apparatus to the clamping frame is possible when the object to be tilted has been fastened. Accordingly, the object can be tilted first in one direction and then in the other direction without having to disconnect the fastening.

In a further development of the invention, the lifting apparatus 24 is detachably connected with the clamping frame and, for reasons of safety, a support, not shown, is connected with the clamping frame in place of the lifting apparatus 24 after the object is tilted. This support is either replaced again by the lifting apparatus for tilting back or enables the apparatus to be tilted back by means of a brake. Accordingly, a plurality of clamping frames can be used alternately with only one lifting apparatus.

I claim:

1. In a lifting and swivelling apparatus comprising a frame having first and second ends, a lifting device having a bottom end and holding means for effecting an articulated connection between the first end of the frame and the lifting device, tie rods for effecting an articulated connection between the frame and the bottom end of the lifting device, an actuating device for vertically adjusting the holding means along the lifting device and for locking the holding means at any vertical location of the lifting device, the improvement comprising the frame being a clamping frame comprising at the second end of the frame a supporting frame, the supporting frame comprising a curved portion curved by essentially 90° and an essentially straight portion connected to the curved portion, the supporting frame having an outer side, the supporting frame being configured to roll on the outer side of the supporting frame during swivelling of the clamping frame and to cause the bottom end of the lifting device simultaneously to approach the supporting frame, further comprising fastening means mounted on the clamping frame for securing the object to be tilted.

2. The lifting and swivelling apparatus according to claim 1, further comprising spreadable extension arms mounted on the supporting frame, the extension arms being configured to limit a tilting angle of the apparatus.

3. The lifting and swivelling apparatus according to claim 1, wherein the clamping frame comprises two substantially parallel support members, further comprising crosspieces interconnecting the parallel members.

4. The lifting and swiveling apparatus according to claim 1, wherein the clamping frame is extendable in a longitudinal direction thereof.

5. The lifting and swivelling apparatus according to claim 4, wherein the clamping frame is extendable telescopically.

* * * * *